United States Patent [19]

Swift

[11] Patent Number: 4,477,231

[45] Date of Patent: Oct. 16, 1984

[54] VARIABLE DISPLACEMENT VANE TYPE PUMP

[76] Inventor: Joseph E. Swift, 47 Highview Rd., South Windsor, Conn. 06074

[21] Appl. No.: 476,104

[22] Filed: Mar. 17, 1983

[51] Int. Cl.[3] ..... F04B 1/06

[52] U.S. Cl. ..... 417/221; 418/16; 418/26; 418/27; 418/177

[58] Field of Search ..... 417/218, 221; 418/16, 418/24–27, 177; 91/497, 498

[56] References Cited

U.S. PATENT DOCUMENTS 2,680,412 6/1956 Entwistle ..... 417/221

3,153,909 10/1964 Balaban ..... 417/221 X

*Primary Examiner*—Edward K. Look

*Attorney, Agent, or Firm*—McCormick, Paulding & Huber

[57] ABSTRACT

A variable displacement vane type hydraulic pump of simple construction automatically varies its output flow rate, between a maximum value and zero, in response to changes in the output pressure. The pump is characterized by a laterally shifting flow modulating member located in a central recess of a vane carrying rotor and whose lateral position is dictated by the pressure existing at the outlet port. The pump can run continuously at a no-flow condition without overheating or stalling and its rotor direction may be reversed by merely reversing the functions of its two ports.

17 Claims, 6 Drawing Figures

VARIABLE DISPLACEMENT VANE TYPE PUMP

BACKGROUND OF THE INVENTION

This invention relates to a variable displacement vane type hydraulic pump, and deals more particularly with such a pump of a simple, inexpensive and reliable construction wherein the displacement of the pump is automatically regulated in response to the output or delivery pressure and wherein for a given application the pump may be so designed that the delivery pressure remains substantially constant throughout a range of delivery rates extending from zero flow to the maximum flow required by the application.

The pump of this invention is particularly well adapted for use in pressurizing gasoline or other liquid fuel in conjunction with a fuel injection system for an internal combustion engine, but its use is not limited to such application and it instead may be used in many other applications to which its characteristics lend themselves.

Prior U.S. Pat. No. 2,635,551; U.S. Pat. No. 2,678,607; U.S. Pat. No. 2,775,946; U.S. Pat. No. 3,070,020; U.S. Pat. No. 3,743,445; and U.S. Pat. No. 3,924,970 show variable displacement vane type pumps each having a laterally shifting flow modulating member for varying the pump displacement. However, in each case the flow modulating member is of relatively large size and surrounds the rotor, making a relatively complex overall construction and, among other things, creating sealing problems.

In contrast to the patents mentioned above, the pump of this invention uses a rotor having a central cylindrical recess receiving a cylindrical cam portion of a flow modulating member with a fluid confining or pumping chamber being defined between the outer surface of the cam portion and the inwardly facing cylindrical surface of the rotor recess. Only a few simple seals are therefore required to prevent leakage from the pump while nevertheless permitting rotation of the rotor relative to its housing.

SUMMARY OF THE INVENTION

This invention resides in a variable displacement vane type hydraulic pump having a rotor supported for rotation in a housing or similar stationary structure. The rotor has a central cylindrical recess receiving the cylindrical cam portion of a flow modulating member supported by the housing for lateral shifting movement. The cam portion has an outer cylindrical surface of lesser diameter than the cylindrical surface of the rotor recess and the cam portion is normally eccentrically positioned relative to the recess surface to define an intervening fluid confining chamber. Radially sliding vanes carried by the rotor engage the cam surface and divide the fluid confining chamber into subchambers which vary in volume as the rotor rotates to create a pumping action with respect to inlet and outlet ports in the housing communicating with the fluid confining chamber. In response to the pressures existing at the inlet and outlet port—which pressures are applied over different portions of the cam outer surface—the flow modulating member is moved laterally against the force of a biasing spring to vary the eccentricity of its cam portion relative to the rotor recess and to thereby vary the displacement and output flow rate of the pump. With no flow from the outlet port the flow modulating member assumes a position at which its cam portion is concentric with the rotor recess thereby establishing a zero displacement for the pump and allowing the pump to run without problem while delivering such no flow through its outlet port. The direction of rotation of the rotor may be reversed by merely reversing the functions of its two ports, making the inlet port for one direction of rotation the outlet port for the other direction of rotation and making the outlet port for the one direction of rotation the inlet port for the other direction of rotation.

DESCRIPTION OF THE PREFERRED EMBODIMENT

Figure 1:
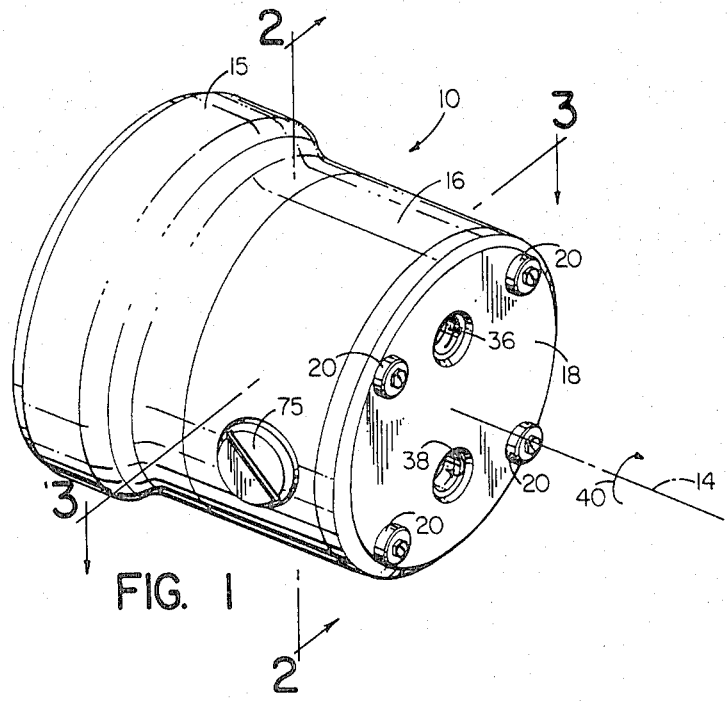
FIG. 1 is a perspective view showing the outside of a pump embodying this invention.
Figure 2:
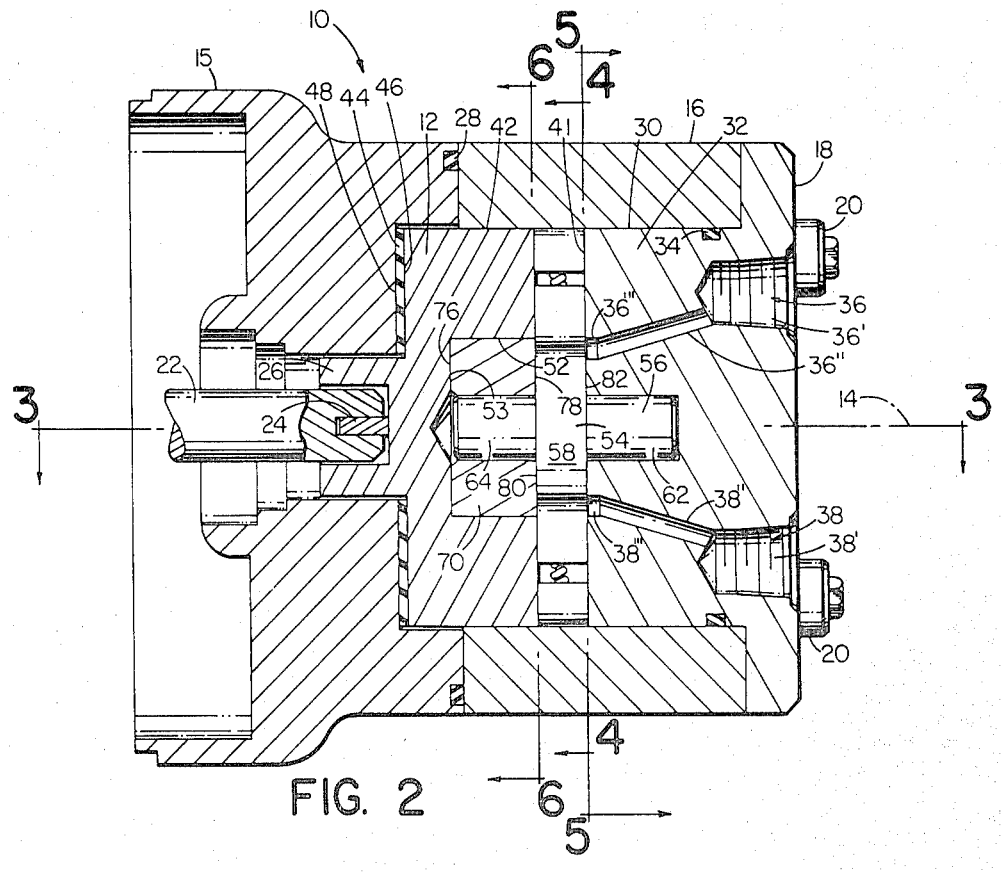
FIG. 2 is a vertical longitudinal sectional view taken generally on the plane containing the line 2—2 of FIG. 1 and FIG. 3.
Figure 3:
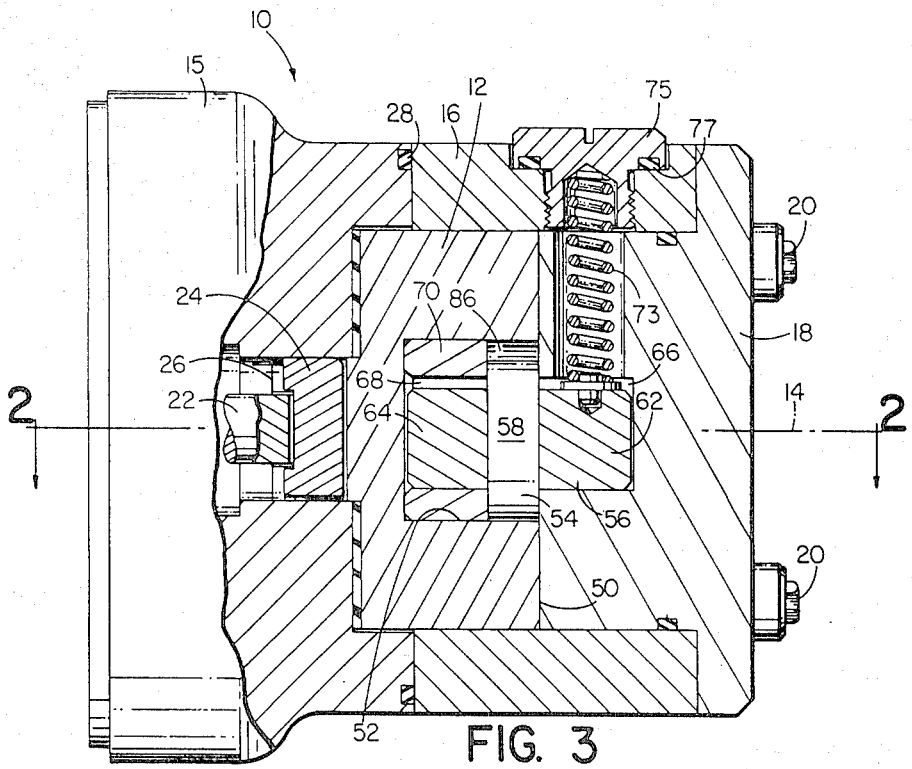
FIG. 3 is a horizontal longitudinal sectional view taken generally on the plane containing the line 3—3 of FIG. 1 and FIG. 2.

Turning to the drawings and first considering FIGS. 1, 2 and 3, a pump 10 embodying this invention comprises a stationary structure defining an internal rotor chamber receiving and supporting a rotor 12 rotatable about its central axis 14. The stationary structure may take various different forms and shapes without departing from the invention, but in the illustrated case is in the nature of a housing consisting of a left-hand member 15 designed to form the end bell of the electric motor used to drive the rotor 12, a cylindrical shell 16 and an end cap 18, with the three parts 15, 16 and 18 being held together by four threaded fasteners 20, 20 passing loosely through the parts 18 and 16 and threaded into the end bell member 15. The output drive shaft of the motor associated with the pump is indicated at 22 and is drivingly connected with the rotor by a drive quill 24 received in aligned transverse slots in the right-hand end of the motor shaft 22 and the left-hand end of a leftwardly projecting stub shaft on the left side of the rotor.

The end bell member 15 and the cylindrical shell 16 are sealed to one another by an annular 0-ring seal 28 carried in a groove in the right-hand end face of the member 15. The cylindrical shell 16 has a cylindrical radially inwardly facing surface 30 which along its right-hand portion receives snugly within it a cylindrical portion 32 of the end cap 18, and the end cap and the cylindrical shell are sealed relative to one another by an annular 0-ring seal 34 carried by a groove in the end cap portion 32.

Figure 4:
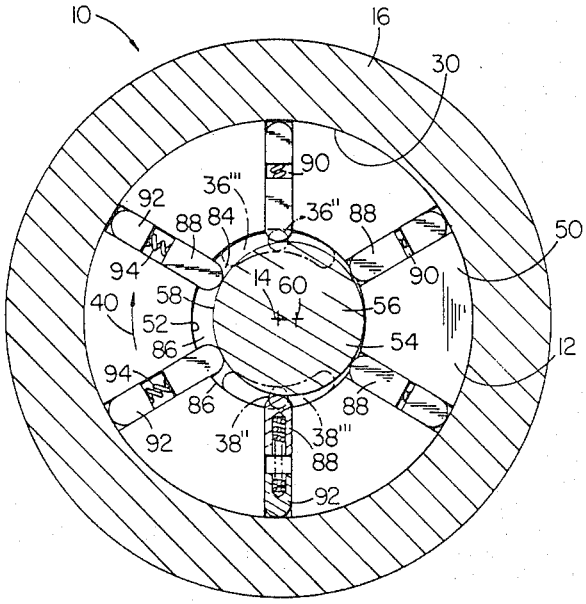
FIG. 4 is a transverse sectional view taken on the plane of the line 4—4 of FIG. 2, with the positions of the inlet and outlet ports being shown in phantom.
Figure 5:
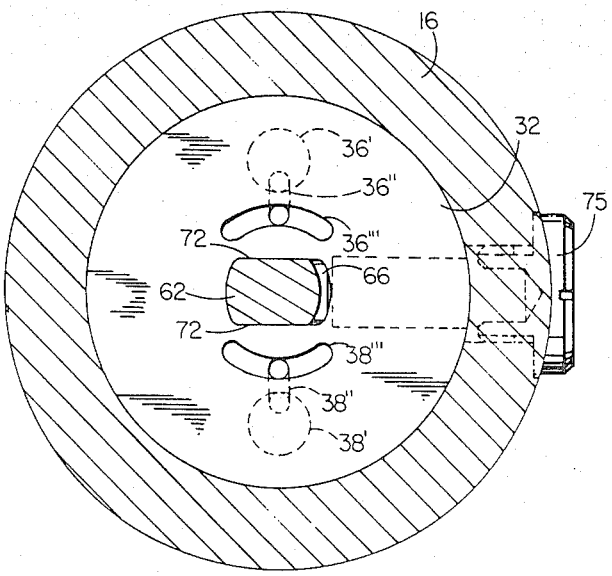
FIG. 5 is a transverse sectional view taken on the plane of the line 5—5 of FIG. 2.
Figure 6:
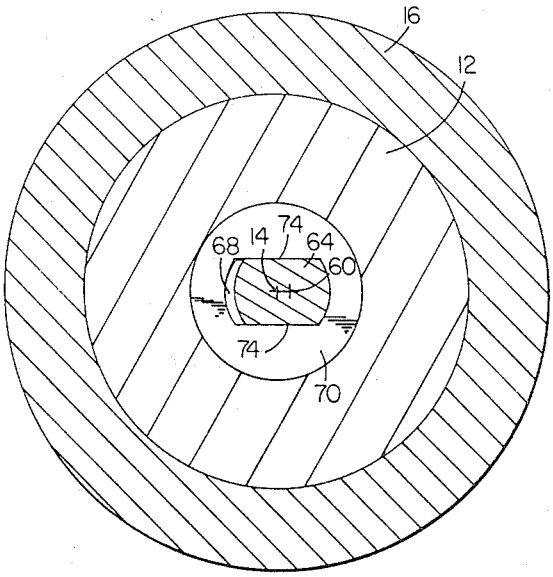
FIG. 6 is a transverse sectional view taken on the plane of the line 6—6 of FIG. 2.

The end cap 18 includes two ports, indicated generally at 36 and 38 in FIG. 1, either of which may be the inlet or outlet port depending on the direction of rotation of the rotor. For the particular construction illustrated and for the direction of rotor rotation indicated by the arrow 40 in FIGS. 1 and 4 the upper port 36 is the outlet or discharge port and the bottom port 38 is the inlet or suction port. As shown in more detail in FIG. 2, the port 36 includes an outer enlarged diameter portion 36', an intermediate portion 36'' and an inner portion 36'''. The enlarged diameter portion 36' is threaded for receiving a fitting used to connect it to a suitable output line. The intermediate portion 36'' passes through the body of the end cap 18 and provides communication between the outer and inner portions 36' and 36'''. The inner portion 36''' communicates with the left-hand end surface 40 of the end cap and extends arcuately for some distance about the rotor axis 14 as shown in phantom in FIG. 4. The port 38 has three similar portions 38', 38'' and 38''' as shown in FIGS. 4 and 5.

The rotor 12 has an outer cylindrical surface 42 of a diameter only slightly less than that of the inwardly facing cylindrical surface 30 of the shell 16 so that the interengagement of the rotor surface 42 and the shell surface 30 provides a rotatable support for the rotor and also provides a significant seal inhibiting escape of fluid between the rotor and shell. Further sealing between the rotor and the housing is provided by an annular seal member 44, which also services as a thrust plate, located between a surface 46 on the left-hand end of the rotor and surface 48 formed in the end bell member 15 and constituting the left-hand end of the rotor chamber, the surfaces 46 and 48 both being planar and perpendicular to the rotor axis 14.

To achieve a pumping action the rotor 12 has a central recess extending leftwardly from its right-hand end surface 50 and defined by a cylindrical radially inwardly facing surface 52 concentric with the rotor axis 14 and by a left-hand end surface 53. Received in the right-hand portion of the recess is the cam portion 54 of a flow modulating member 56. The cam portion 54 has an outer cylindrical surface 58 of lesser diameter than the recess surface 52 so that the cam portion is loosely received in the recess. Further the flow modulating member 56 is supported by the housing for lateral shifting movement to vary the eccentricity of the cam portion axis 60, shown in FIG. 4, relative to the rotor axis 14. In FIG. 4 the flow modulating member 56 is shown at a position in which the cam portion 60 has a maximum eccentricity with respect to the rotor axis 14. From this position the flow modulating member is movable to the left in FIG. 4 until the cam portion axis 60 coincides with the rotor axis 14 with this latter position therefore constituting one of zero eccentricity.

The means supporting the flow modulating member for lateral shifting movement comprise two legs 62 and 64 extending in opposite directions from the cam portion 54. The first leg 62, as seen best in FIGS. 3 and 5, extends to the right from the cam portion 54 and is slidably received in an elongated slot 66 formed in the end cap 18. The second leg 64 extends to the left from the cam portion 54 and is received in an elongated slot 68 in a bushing 70 received in the left-hand portion of the rotor recess. The bushing 70 has a cylindrical outer surface of only slightly less diameter than that of the recess cylindrical surface 52 so that it is supported by the rotor for rotation relative to the rotor about the rotor axis 14. The flow modulating member 56 is in turn nonrotatable relative to the housing and is kept from such rotation by two flats 72, 72 on its leg 62 which engage corresponding flat surfaces of the end cap slot 66. Likewise, the bushing 70 is restrained against rotation relative to the flow modulating member by two flats 74, 74 on the leg 64 which engage corresponding flat surfaces of the bushing slot 68.

As indicated in FIG. 2 the bushing 70 has a left-hand end surface 76 flatly engaging the recess surface 53 and has a right-hand end surface 78 flatly engaging the left-hand end surface 80 of the cam portion 58, all of the surfaces 53, 76, 78 and 80 being planar and perpendicular to the rotor axis 14. At its right-hand end the cam portion 58 has an end surface 82 coplanar with the rotor right-hand end surface 50 and the end cap lefthand end surface 41. The flow modulating member 56 is further biased toward its position of maximum eccentricity, as best shown in FIG. 3, by a compression spring 73 working between the leg 62 and a cap 75 threaded into the cylindrical member 16 and sealed by an 0-ring 77 in the head of the cap.

As best seen in FIG. 4, the arrangement of surfaces previously described defines a fluid confining pumping chamber 84 located between the rotor recess cylindrical surface 52, the cam portion outer surface 58, the bushing right-hand end surface 78 and the end cap left-hand end surface 41. This chamber 84 is further divided into six subchambers 86, 86 by six vanes 88, 88 carried by the rotor 12. Each vane 88 is carried by a radial slot 90 in the rotor for radial sliding movement relative to the rotor and has a radially inner end sealingly engaging the cam portion surface 58. In addition to its associated vane 88, each rotor slot 90 slidably carries a second radially outer vane 92 having an outer end sealingly engaged with the cylindrical inner surface 30 of the member 16. A compression spring 94 associated with each pair of vanes 92 and 88 urges its associated vane 88 inwardly into engagement with the cam portion 58 and its associated vane 92 outwardly into engagement with the shell member surface 30.

Referring to FIG. 4, it can now be understood that as the rotor 12 rotates in the direction of the arrow 40 relative to the cylindrical shell 16 the subchambers 86, 86 of the fluid confining chamber will vary in size as they pass the adjacent arcuate portions 36''' and 38''' of the outlet and inlet ports, with each subchamber being of increasing size as it passes the inlet port portion 38''' and of a decreasing size as it passes the outlet port portions 36''' thereby creating a pumping action. Further it will be understood that as the pump operates the outlet pressure will be greater than the inlet pressure and will cause a pressure differential on opposite sides of the cam portion 56 producing a resultant force tending to shift the cam portion 56 toward the left in FIG. 4 against the force of the biasing spring 73. Thus, after the pressure differential between the inlet and outlet ports reaches a given amount at which the force exerted by it on the flow modulating member balances the force exerted on the same member by the spring 73, further increases in the pressure differential will cause the flow modulating member to shift to the left in FIG. 4 reducing the displacement and the flow rate of the pump, and after the pressure differential reaches a given maximum value the cam portion 56 will become concentric with the rotor recess at which point the displacement and the output flow rate will be zero, but in this condition the pump can still run properly without overheating or creating any other problems.

From the above discussion it will also be apparent that the spring 73 may be designed so as to exert a predetermined amount of preload on the flow modulating member and to have a predetermined spring constant. For a given application of the pump the values of the preload and spring constant may further be chosen so that the pump delivers liquid at a substantially constant pressure between the maximum required flow rate and a zero flow. That is, the spring may be designed so that at the maximum flow rate and the desired output pressure the force exerted by the output pressure on the modulating member only balances or slightly overbalances the preload of the spring so that the cam portion remains in or near its most eccentric position corresponding to maximum pump displacement, with the spring in addition being further designed so as to have a relative low spring constant. Therefore, if the application demands less than the maximum delivery rate only a small increase in output pressure will be required to shift the flow modulating member to the position producing such lower delivery rate, and the shift may be made to as far as the zero eccentricity or zero displacement position without producing a very substantial or intolerable increase in the output pressure.

I claim:

1. A variable displacement vane type pump comprising:

a stationary structure, a rotor supported by said stationary structure for rotation relative thereto about a horizontal rotor axis, said rotor having a cylindrical radially outwardly facing outer surface concentric with said axis and also having a right-hand end surface, said rotor having a recess extending leftwardly from said rotor right-hand end surface which recess is defined in part by a radially inwardly facing surface generally symmetrical about said axis, a flow modulating member having a cam portion with right and left-hand ends located in said rotor recess, said cam portion having a radially outwardly facing cylindrical cam surface, concentric about a corresponding cam portion axis, of such diameter that said cam portion fits radially loosely in said rotor recess, means supporting said flow modulating member from said stationary structure so that said cam portion axis is parallel to said rotor axis and so that said modulating member is laterally movable relative to said stationary structure, to vary the spacing between said rotor axis and said cam portion axis, between a position at which said cam portion has a maximum eccentricity relative to said rotor axis and a position of lesser eccentricity, means biasing said modulating member relative to said stationary structure toward said position of maximum eccentricity, means at both said right and left-hand ends of said cam portion closing the radial space between said radially inwardly facing recess surface and said radially outwardly facing cam surface to define a fluid confining chamber between said recess surface and said cam surface, means providing an inlet port and an outlet port in said stationary structure both communicating with said fluid confining chamber, said inlet and outlet ports being located respectively on opposite sides of the plane of movement of said cam portion axis, a plurality of vanes carried by said rotor for radial sliding movement relative to said rotor and engageable at their inner ends with said cam surface, and means biasing said vanes radially inwardly relative to said rotor into engagment with said cam surface, said vanes extending axially across the full extent of said fluid confining chamber so as to divide said fluid confining chamber into a plurality of fluid confining sub-chambers which move with said rotor and which sub-chambers are increasing in volume as they pass said inlet port and are decreasing in volume as they pass said outlet port.

2. A variable displacement vane type pump as defined in claim 1 further characterized by said radially inwardly facing recess surface being cylindrical.

3. A variable displacement vane type pump as defined in claim 1 further characterized by said position of lesser eccentricity being one in which said axis of said cam portion is colinear with said rotor axis so that said eccentricity is zero.

4. A variable displacement vane type pump as defined in claim 1 further characterized by said rotor at its right hand end having a planar end surface perpendicular to said rotor axis and said cam portion at its right hand end having a planar end surface perpendicular to said rotor axis and coplanar with said rotor right hand end surface, and said stationary structure including a wall to the right of said rotor and said cam portion with said wall having a left hand planar end surface adjacent said rotor and cam portion right hand end surfaces, said wall surface closing the radial space between said inwardly facing recess surface and said cam surface at the right hand ends of said rotor and cam portion.

5. A variable displacement vane type pump as defined in claim 4 further characterized by said inlet and outlet ports being located in said wall.

6. A variable displacement vane type pump as defined in claim 4 further characterized by said means supporting said flow modulating member including said flow modulating member having a leg extending rightwardly from said cam portion, and said wall having an elongated slot slidably receiving said leg and restraining said flow modulating member to lateral sliding movement relative to said stationary structure.

7. A variable displacement vane type pump as defined in claim 6 further characterized by said leg having at least one flat engageable with one side surface of said slot to prevent rotation of said flow modulating member relative to said stationary structure.

8. A variable displacement vane type pump as defined in claim 6 further characterized by said biasing means comprising a spring working between said leg and said stationary structure and biasing said leg toward one limit of its sliding movement along said slot and resiliently resisting movement of said leg away from said limit position.

9. A variable displacement vane type pump as defined in claim 6 further characterized by a bushing in said rotor recess to the left of said flow modulating member cam portion, said flow modulating member having a second leg extending leftwardly from said cam portion, and said bushing having an elongated slot slidably receiving said second leg of said flow modulating member.

10. A variable displacement vane type pump as defined in claim 9 further characterized by said bushing being supported in said rotor for rotation relative to said rotor about said rotor axis and said second leg having at least one flat engageable with a corresponding side surface of said slot in said bushing to prevent relative rotation between said second leg and said bushing.

11. A variable displacement pump as defined in claim 6 further characterized by said radially inwardly facing recess surface being cylindrical, a bushing in said rotor recess to the left of said flow modulating member cam portion, said bushing having a cylindrical outer surface closely adjacent said inwardly facing recess surface so as to be rotatably supported by said rotor, said bushing further having a right-hand end surface adjacent the left-hand end of said cam portion radially closing the space between said inwardly facing recess surface and said cam surface, said flow modulating member having a second leg extending leftwardly from said cam portion, and said bushing having an elongated slot slidably receiving said second leg of said flow modulating member.

12. A variable displacement vane type pump as defined in claim 1 further characterized by said stationary structure having a cylindrical rotor chamber receiving said rotor, said cylindrical rotor chamber having a horizontal axis colinear with said rotor axis and being defined in part by an inwardly facing cylindrical surface, said rotor having a cylindrical radially outwardly facing outer surface closely adjacent to said inwardly facing cylindrical surface of said rotor chamber so that said rotor is rotatably supported for rotation about its axis by the coengagement between said radially inwardly facing cylindrical surface of said rotor chamber and said radially outwardly facing rotor surface.

13. A variable displacement vane type pump as defined in claim 12 further characterized by said stationary structure including a cylindrical shell the inner surface of which constitutes at least part of said radially inwardly facing cylindrical surface of said rotor chamber, said rotor and said flow modulating member cam portion having coplanar right hand end surfaces perpendicular to said rotor axis, said cylindrical shell extending rightwardly beyond said right hand end surfaces of said rotor and cam portion, and an end cap fixed to said cylindrical shell to the right of said rotor, said end cap including a portion received within said inner surface of said shell and providing a wall located to the right of said rotor, said wall having a planar left hand end surface engaging said right hand end surfaces of said rotor and cam portion and radially closing the space between said inwardly facing recess surface and said cam surface.

14. A variable displacement vane type pump as defined in claim 13 further characterized by said inlet and outlet ports being located in said end cap.

15. A variable displacement vane type pump as defined in claim 13 further characterized by said stationary structure further including an electric motor end bell fixed to the left hand end of said cylindrical shell, said end bell being adapted to form part of the housing of an electric motor used to drive said rotor.

16. A variable displacement vane type pump as defined in claim 13 further characterized by said stationary structure defining a left hand planar end surface perpendicular to said rotor axis for said rotor recess, and said rotor having a planar left hand end surface perpendicular to said rotor axis, and an annular seal member positioned axially between said left hand rotor chamber end surface and said left hand rotor end surface.

17. A variable displacement vane type pump as defined in claim 12 further characterized by said rotor having a plurality of slots for receiving said vanes, each of said slot extending radially from said radially inwardly facing recess surface of said rotor to said radially outwardly facing cylindrical outer surface of said cam portion, each of said vanes being one of a set of first vanes each of which first vanes is radially slidably received in a radially inward portion of a respective one of said rotor slots, and a set of second vanes each of which second vanes is radially slidably received in a radially outer portion of a respective one of said rotor slots, and a spring between the first vane and the second vane of each rotor slot, said spring urging its associated first vane radially inwardly into engagement with said cam portion outer surface and urging its associated second vane radially outwardly into engagement with said radially inwardly facing cylindrical surface of said rotor chamber.

* * * * *